US009376302B2

(12) United States Patent
Kronawitter et al.

(10) Patent No.: US 9,376,302 B2
(45) Date of Patent: Jun. 28, 2016

(54) DEVICE FOR SEALING CONTAINERS

(75) Inventors: Michael Kronawitter, Beimerstetten (DE); Joachim Noe, Ehingen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 797 days.

(21) Appl. No.: 13/369,759

(22) Filed: Feb. 9, 2012

(65) Prior Publication Data

US 2012/0222388 A1 Sep. 6, 2012

(30) Foreign Application Priority Data

Mar. 3, 2011 (EP) ..... 11156883

(51) Int. Cl.
*B67B 3/20* (2006.01)
*B65B 7/28* (2006.01)

(52) U.S. Cl.
CPC ..... *B67B 3/2053* (2013.01); *B65B 7/2835* (2013.01)

(58) Field of Classification Search
CPC ..... B67B 1/06; B67B 1/005; B67B 3/00; B67B 3/06; B67B 3/062; B67B 3/0645; B67B 3/10; B67B 3/20; B67B 3/204; B67B 3/2053; B67B 7/2835; B67B 7/28; B67B 7/2807; B67B 7/2821; B67B 7/2842; B67B 35/16; B67B 61/202; B65G 47/907
See application file for complete search history.

(56) References Cited

U.S. PATENT DOCUMENTS 1,494,365 A * 5/1924 McKnight ..... B67B 3/062 221/188
5,398,480 A * 3/1995 Bankuty ..... B67B 3/2046 53/315
5,493,849 A * 2/1996 Itoh ..... B65B 7/2821 53/319
5,584,161 A * 12/1996 Zanini et al. ..... 53/317
5,809,742 A * 9/1998 Takakusaki ..... B65B 55/24 53/317
2007/0006550 A1* 1/2007 Kemper ..... A61L 2/22 53/426
2010/0101192 A1* 4/2010 Krevald ..... 53/490
2010/0218456 A1* 9/2010 Skarin ..... B65B 61/186 53/133.3

FOREIGN PATENT DOCUMENTS

DE 1006292 B 4/1957
EP 0745555 A1 12/1996
EP 0863106 A1 9/1998
EP 745555 B1 * 3/1999
WO WO 2005/007556 1/2005

OTHER PUBLICATIONS

EP Search Report for EP 11156883 dated Aug. 4, 2011.

* cited by examiner

*Primary Examiner* — Gloria R Weeks
*Assistant Examiner* — Chinyere Rushing-Tucker
(74) *Attorney, Agent, or Firm* — Brinks Gilson & Lione

(57) ABSTRACT

The device for sealing containers comprises a container feeding device for an intermittent feed of containers in a transport direction, a cap feeding device having a plurality of cap gripper units; and a capping device movable in and opposite to a lowering direction. The capping device has a plurality of capping units corresponding to the plurality of cap gripper units in the cap feeding device. Each capping unit has a screwing-on mechanism at one end. Each screwing-on mechanism is adapted to pick up a cap and to seal the container with the cap in a lowered position of the capping device. The capping device and the plurality of cap gripper units of the cap feeding device are configured and arranged such that the plurality of cap gripper units of the cap feeding device are positively guided in the lowering direction.

20 Claims, 5 Drawing Sheets

DEVICE FOR SEALING CONTAINERS

RELATED APPLICATIONS

The present patent document claims the benefit of priority to European Patent Application No. EP 11156883.8, filed Mar. 3, 2011, and entitled "DEVICE FOR SEALING CONTAINERS" the entire contents of each of which are incorporated herein by reference.

FIELD AND BACKGROUND

The present invention relates to a device for sealing upright containers.

Devices of this type are used as part of filling and packaging systems in the cosmetic and pharmaceutical industries, for example, and often work intermittently, wherein a certain number of containers, which are delivered containing products, are sealed simultaneously from above by several capping units while the containers are stopped for a brief time. The caps are usually supplied separately from the side and in such a way that the capping units, in a process which includes several movements, pick up the supplied caps and then apply them to the containers by screwing them on, for example.

Only a short amount of time is available for this process, during which the supplied caps must be picked up and moved down into a lowered position so that they can be applied to the containers. Relatively heavy weights must be moved in this short time.

An improved design of a capping unit is described in DE 199 46 374 A1. Here the delivered caps are drawn up by a vacuum present inside the cap-screwing mechanism. This vacuum is then turned off shortly before the cap is screwed on.

BRIEF SUMMARY

It is an object of the present invention to provide a device for sealing containers which offers faster throughputs and at the same time leads to only modest maintenance costs because of its sturdy construction and simple design.

According to an aspect of the invention, the device for sealing containers comprises a container feeding device for an intermittent feed of containers in a transport direction, a cap feeding device having a plurality of cap gripper units; and a capping device movable in and opposite to a lowering direction. The capping device has a plurality of capping units corresponding to the plurality of cap gripper units in the cap feeding device. Each capping unit has a screwing-on mechanism at one end. Each screwing-on mechanism is adapted to pick up a cap and to seal the container with the cap in a lowered position of the capping device. The capping device and the plurality of cap gripper units of the cap feeding device are configured and arranged such that the plurality of cap gripper units of the cap feeding device are positively guided in the lowering direction by the capping device when the capping device is moved in the lowering direction.

As a result of this positive guidance, the capping device carrying the capping units can move in the lowering direction without an intermediate stop. This offers considerable design advantages, because it is necessary to actuate and control the movement in only one direction.

The lowering direction is preferably substantially perpendicular to the transport direction of the container feeding device. This makes it possible to seal several containers with caps simultaneously. It is also possible for the containers to be delivered on a circular path.

The capping device advantageously comprises a driver element, which cooperates with a stop on the cap feeding device, so that the movement of the capping device in the lowering direction brings about the positive guidance of the number of cap gripper units. This makes it possible, during the time in which new containers are being brought up in the transport direction by the container feeding device and in which the capping device with its capping units is located in the starting positions, the cap feeding device with the cap gripper units can be moved back perpendicular to the transport direction of the containers and perpendicular to the lowering direction, and the cap gripper units can pick up new caps. When the cap feeding device with the new caps then reaches the capping position in the horizontal plane and simultaneously the capping units of the capping device start to move in the lowering direction, the driver element of the capping device makes contact with the stop on the lowering plate of the cap feeding device and thus produces the positive guidance, wherein the capping units grip the caps now positioned above the containers and are able by themselves to hold them there. After the cap gripper units have released the caps, the cap feeding device can be moved back again perpendicular to the transport direction and perpendicular to the lowering direction.

The stop on the cap feeding device is preferably arranged on a lowering plate, wherein the lowering plate, when moving in the lowering direction, acts against the elastic force of one or more spring elements. The one or more spring elements are advantageously arranged between the lowering plate and a horizontally movable slide of the cap feeding device.

The overall design of the lowering plate, the spring elements, and the horizontally movable slide, all of which are components of the cap feeding device, makes it possible in a simple manner to bring the cap feeding device back to its starting position. When the slide is moved horizontally toward the rear, the cap gripper units fastened to the lowering plate move away from the containers and the capping units again, and the stop on the lowering plate moves under and past the drive element of the capping device in such a way that the cooperation between the components is interrupted again. As a result, the force of the spring elements acts on the lowering plate opposite the lowering direction and moves the lowering plate upward. After the horizontally movable slide has traveled back all the way, the starting position of the cap feeding device has been reached again, so that the next capping cycle can begin.

The horizontally movable slide is preferably driven by a spindle drive.

It is especially advantageous for each cap gripper unit to comprise a pneumatic drive for gripping and releasing the caps. These pneumatic drives are reliable and simple in design. Alternatively, however, it would also be possible to use other suitable drives for the cap gripper units.

It is advantageous for each capping unit to comprise a spindle drive for screwing the caps onto the containers in the lowering direction. The caps preferably comprise an internal thread, the containers an external thread.

BRIEF DESCRIPTION OF THE DRAWINGS

The present invention is explained in greater detail below on the basis of exemplary embodiments, which are illustrated schematically in the drawings.

DETAILED DESCRIPTION OF SPECIFIC EMBODIMENTS

Figure 1:
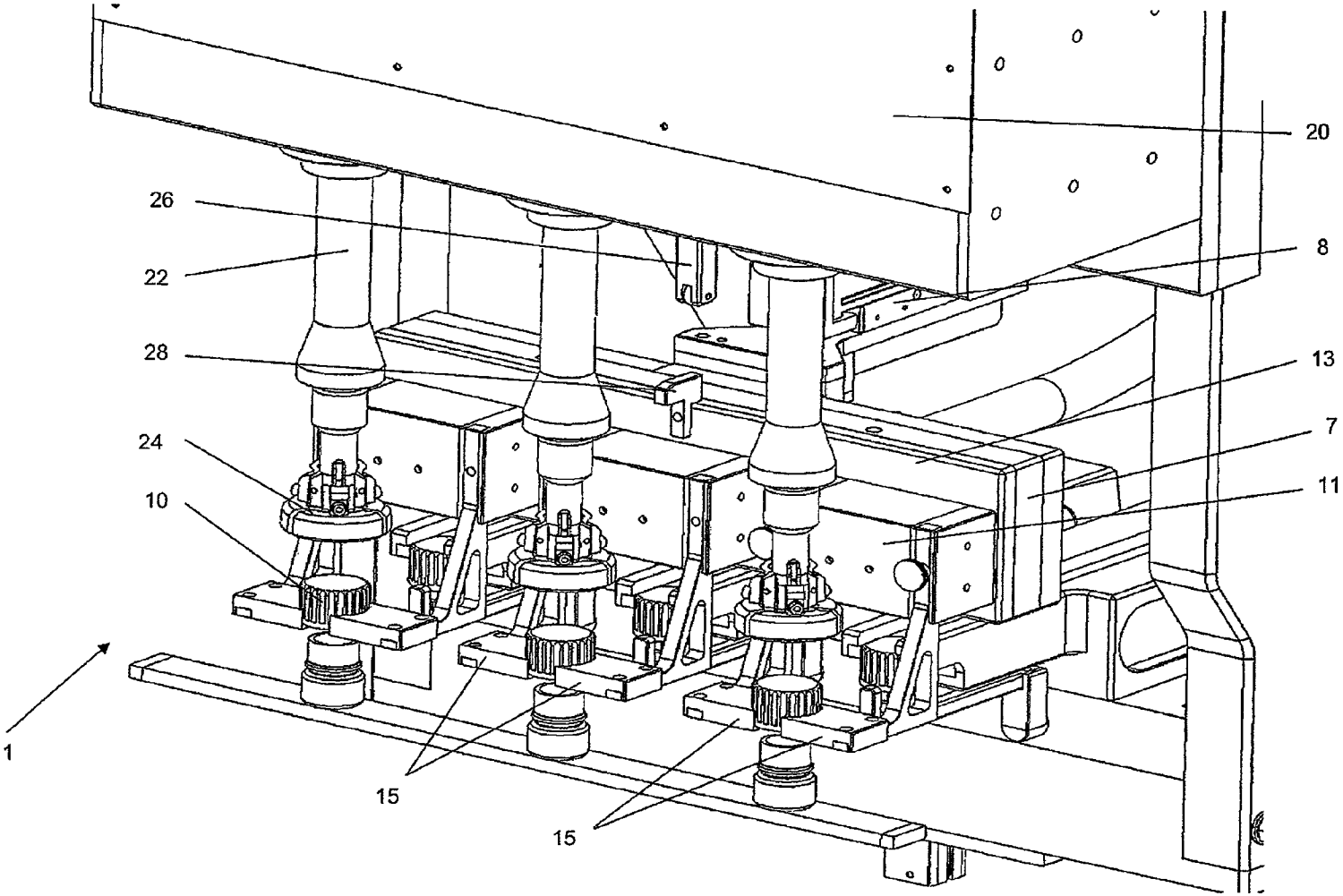
FIG. 1 is a perspective view of a preferred embodiment of the device for sealing containers according to the invention in a first position.
Figure 2:
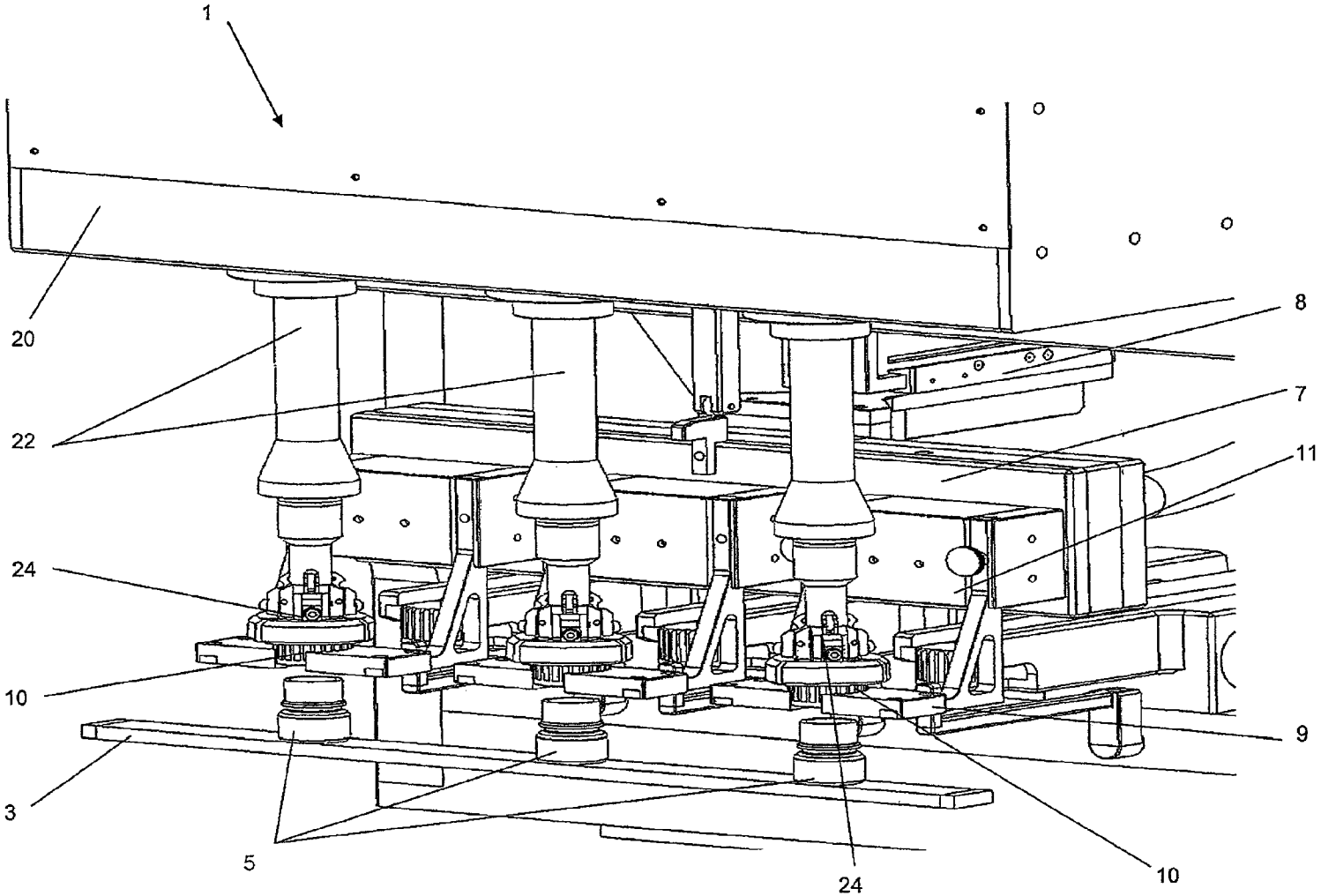
FIG. 2 is a perspective view of the device of FIG. 1 in a second position.
Figure 3:
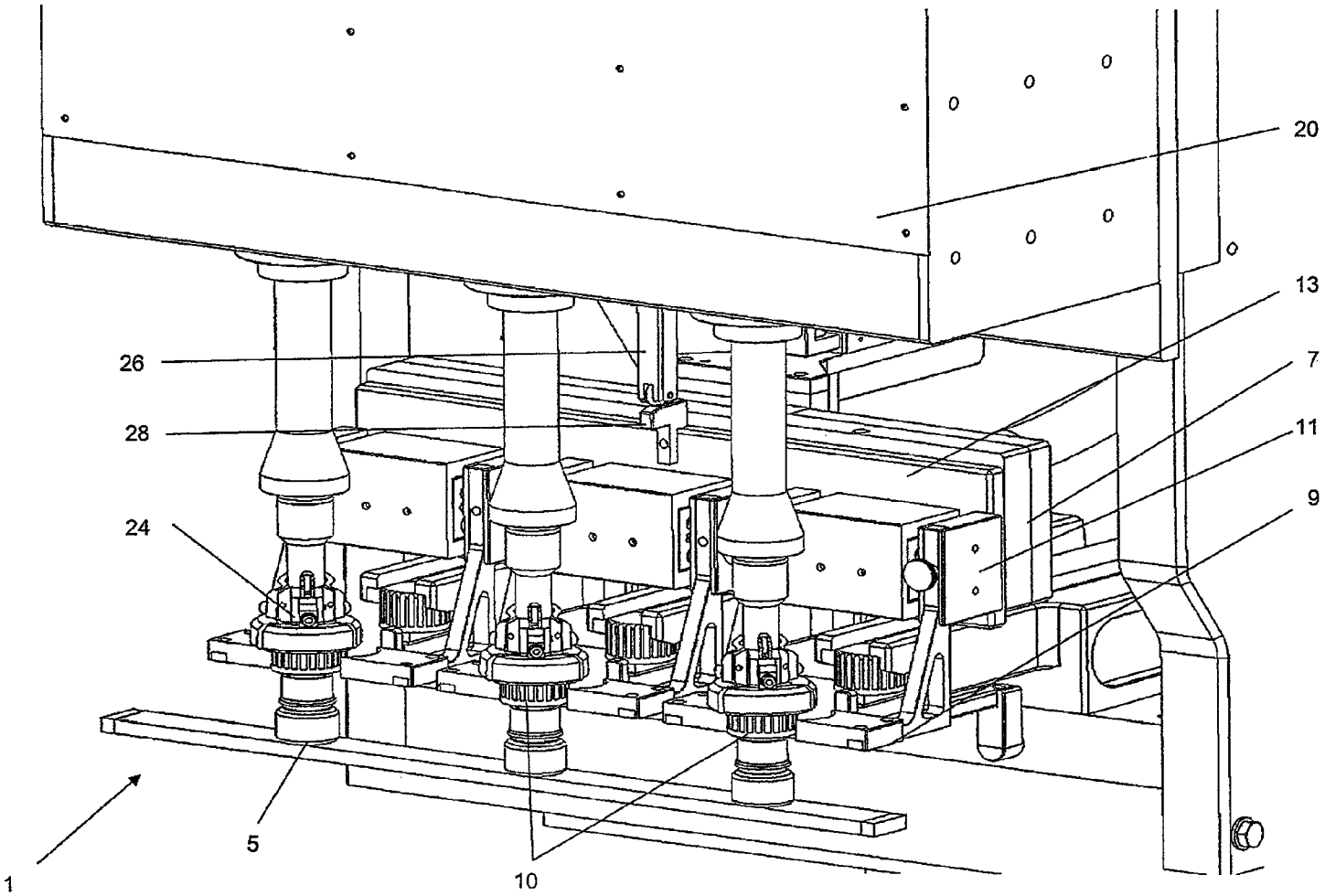
FIG. 3 is a perspective view of the device of FIG. 1 in a third position.

FIGS. 1 to 3 are perspective diagrams of a preferred embodiment of the device for sealing containers. The device 1 comprises a fixed frame 2 and a container feeding device 3, on which a plurality of containers 5 is transported in a transport direction from left to right. The device 1 for screwing caps 10 onto containers 5 is provided with appropriate threads, wherein in the embodiment shown exactly three containers 5 can be sealed simultaneously at a rate of as many as approximately 150 containers per minute.

The device 1, furthermore, comprises a cap feeding device 7, which comprises a horizontally movable slide 8, which is mounted movably on the frame 2. The cap feeding device 7 comprises three cap gripper units 9 arranged along the container feeding device 3. A cap 10 for sealing a container 5 is clamped in each cap gripper unit 9. The caps 10 are delivered from the rear by the cap feeding device 7 in a direction perpendicular to the transport direction of the container feeding device 3.

The device 1 also comprises a capping device 20, which is arranged in the upper area of the frame 2 with the freedom to move in such a way that, for example, it can be moved downward by means of a servomotor in a lowering direction and upward, opposite the lowering direction. In the embodiment shown here, the servomotor drives the capping device 20 in linear fashion.

The capping device 20 comprises three capping units 22, at the end of each of which a screwing-on mechanism 24 is arranged. The screwing-on mechanisms 24 are actuated by spindle drives, which are driven by servo motors (not shown). The screwing-on mechanisms 24 are set up in such a way that a screwing head can pick up a cap 10 as the screwing head travels down in the lowering direction, set the cap 10 down onto the container 5 and screw it on.

The position of the components of the device 1 for sealing containers shown in FIG. 1 displays a first intermediate situation in the screwing-on cycle. The upright containers 5 have already been conveyed to the appropriate sealing position by the container feeding device 3. The cap feeding device 7 is no longer in the retracted position, in which each of the cap gripper units 9 had picked up a cap 10 for the screwing-on cycle. Instead, the cap feeding device 7 has already conveyed the caps 10 by means of the horizontally movable slide 8 from the rear to the position above the containers 5 to be sealed. In the embodiment shown, the caps 10 are held by jaws 15, which are actuated by a pneumatic drive 11. Alternatively, it is also conceivable that some other type of drive, such as an electric drive, could actuate the jaws 15.

In FIG. 1, the capping device 20 with its capping units 22 stands in an upper position, before it is lowered. The capping units 22 are a certain distance above the containers 5 which have been delivered by the container feeding device 3. As mentioned above, the cap feeding device 7 has been moved forward perpendicular to the transport direction of the container feeding device 3 and also perpendicular to the lowering direction of the capping device 20 and is located in its front position.

FIG. 2 shows the device of FIG. 1 in the next position of the screwing-on cycle, in which the caps 10 in the cap gripper units 9 are still located precisely between the containers 5 and the screwing-on mechanisms 24 of the capping device 20. It is clearly shown how the jaws 15 of the cap gripper units 9 hold the caps 10 in such a way that the screwing-on mechanisms 24 can grip the caps 10 as the capping device 20 moves down in the lowering direction.

In the position shown in FIG. 2, the capping device 20 has already been lowered, and it can be seen that a driver element 26 on the capping device 20 has engaged with a stop 28, which is mounted on a lowering plate 13 of the cap feeding device 7. The driver element 26 comprises at its lower end a plunger or preferably a roller.

When the driver element 26 makes contact with the stop 28, the screwing-on mechanisms 24 grip the caps 10 from above, so that they can be screwed onto the containers 5. The caps 10 are then preferably held mechanically by the screwing-on mechanisms 24, although vacuum suction can also be used supplementally.

During the following, joint lowering movement of the capping device 20 and the cap gripper units 9, the jaws 15 driven by the pneumatic drive 11 release the caps 10, which are now held solely by the screwing-on mechanisms 24.

FIG. 3 shows this next position of the screwing-on cycle of the device 1, where the capping device 20 together with its capping units 22 and the screwing-on mechanisms 24 has been moved further downward from the position shown in FIG. 2 onto the caps 10, and the jaws 15 have moved aside to release the caps 10. Now, the cap feeding device 7 can be moved back to the rear.

This position is achieved because the driver element 26 of the capping device 20 had come into contact with the stop 28 and had pushed the cap gripper units 9 a substantial length in the lowering direction. In the example shown, this positive guidance acts on the lowering plate 13, on which the cap gripper units 9, including the pneumatic drives 11, are mounted. Other arrangements are conceivable.

When the cap feeding device 7 now travels back from the position shown in FIG. 3 by means of the horizontally movable slide 8, which in turn is driven by the linear drive 32, the stop 28 slides under and past the driver element 26, thus interrupting the positive guidance and the interaction between the cap gripper units 9 and the capping device 20. The result of this is that the lowering plate 13 is moved upward, opposite the lowering direction, as will be explained in the following with reference to FIG. 4.

Figure 4:
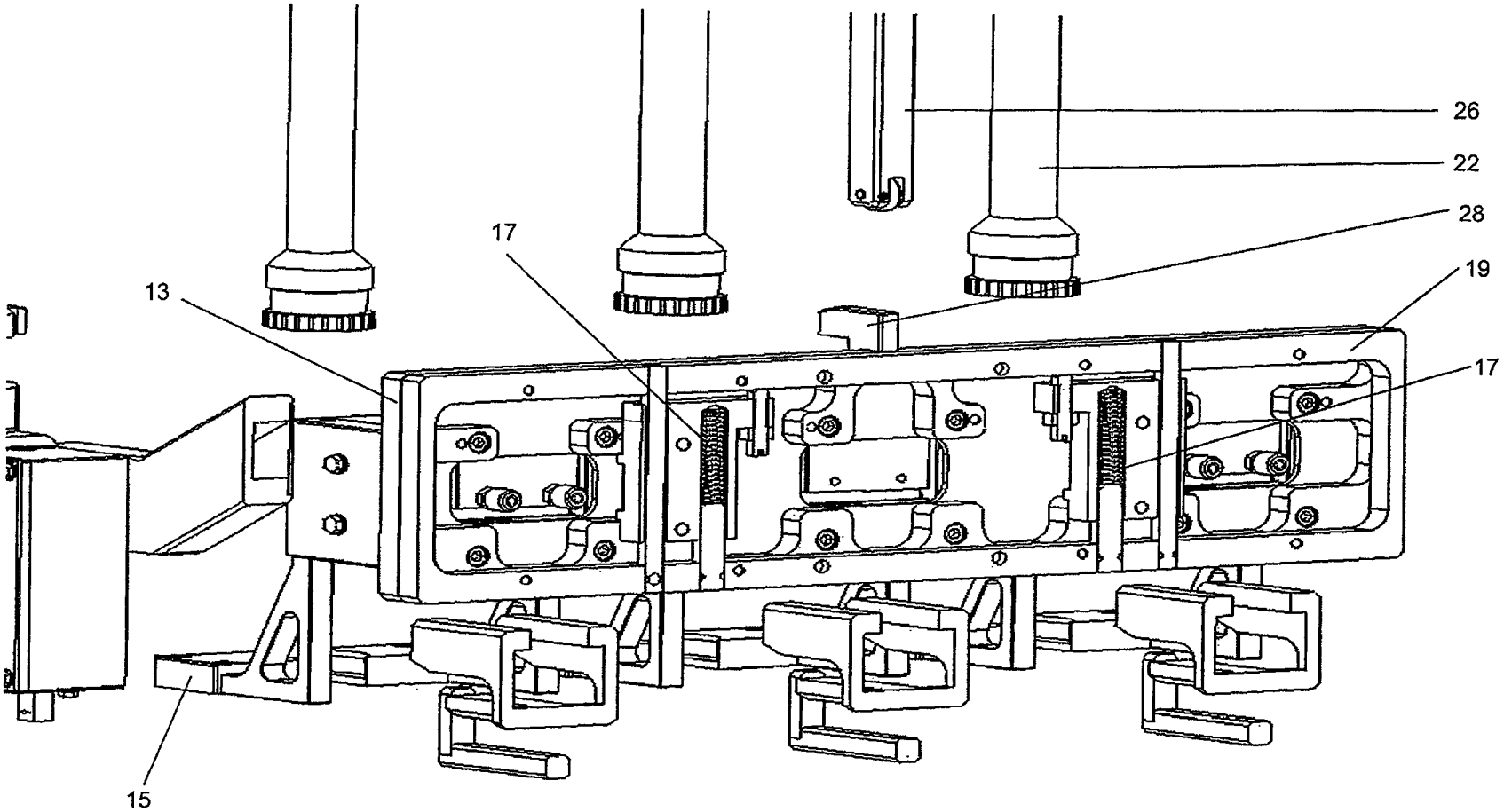
FIG. 4 is a perspective view, from the rear, of selected components of the device according to the embodiment shown in FIGS. 1-3.

FIG. 4 is a perspective rear view of part of the device according to the embodiment shown in FIGS. 1-3, especially the components used to provide the positive guidance of the cap gripper units 9. The lowering plate 13 is shown, on the front of which (not visible in FIG. 4) the cap gripper units 9 and the stop 28 are mounted. The rear of the lowering plate 13 is attached to a holding frame 19 in such a way that the plate can move in the lowering direction; the frame in turn is rigidly connected to the slide 8. The lowering plate 13 also comprises openings extending in the lowering direction, in which spring elements 17 are arranged. The bottom end of each spring rests on a stop, which is connected to the holding frame 19 and which is free to move in the opening. The top end of each spring presses against the end of the opening and thus against the lowering plate 13. The spring elements 17 are firmly seated in the openings, wherein, because the holding frame 19 does not move in the vertical direction, a movement of the lowering plate 13 in the lowering direction has the effect of compressing the spring elements 17.

The interruption of the positive guidance of the lowering plate 13 with its cap gripper units 9 as a result of the horizontal displacement of the slide 8 toward the rear thus has the effect that the elastic force of the spring elements 17 can move the lowering plate 13 back upward again, namely, to its starting position relative to the holding frame 19. Other return mechanisms are also conceivable, such as one operating with a counterweight (that is, by means of gravity) or by magnetic force.

Figure 5:
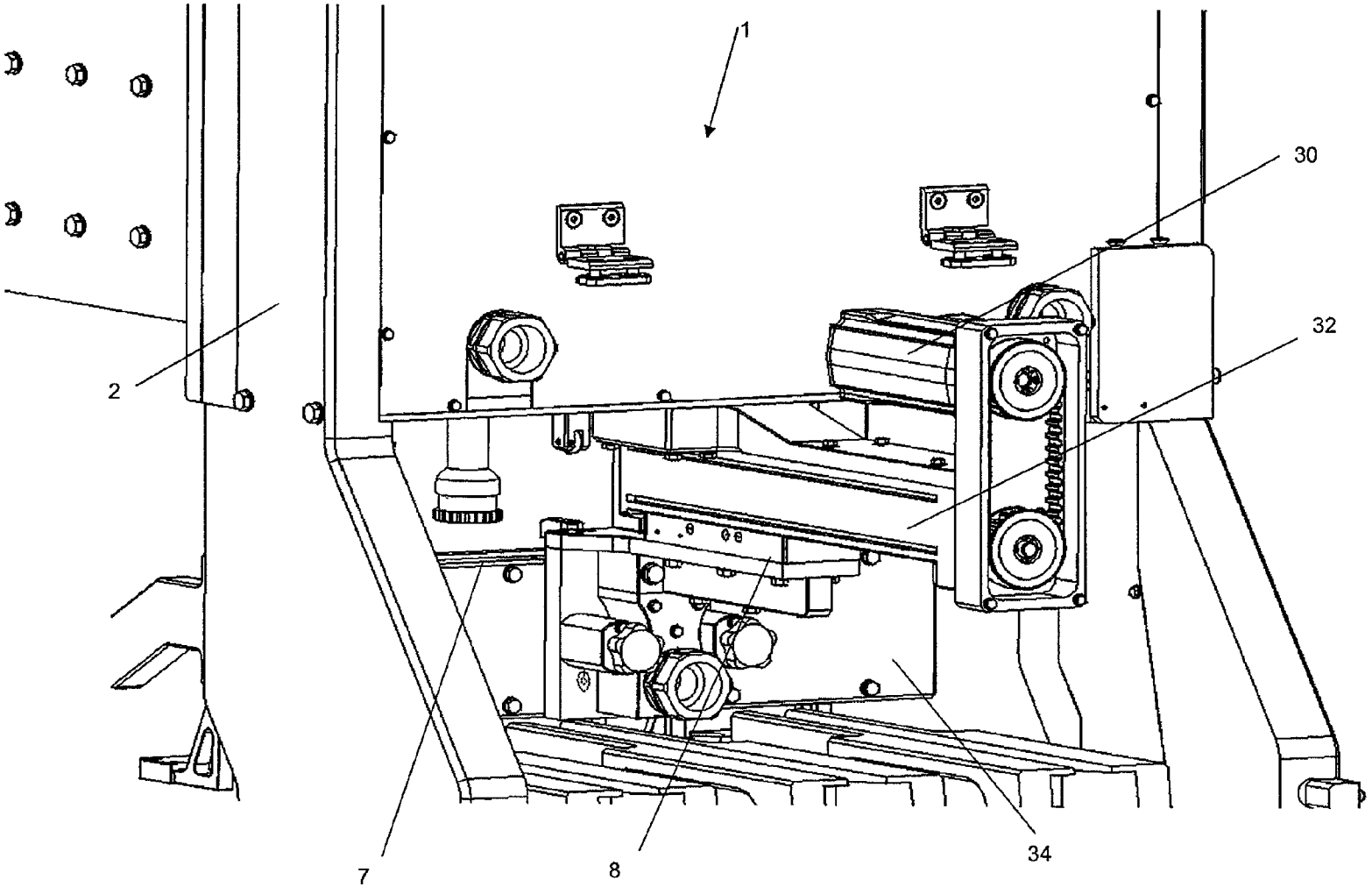
FIG. 5 is a perspective view, from the rear, of the device according to the embodiment shown in FIGS. 1-3.

FIG. 5 is a perspective rear view of the device, wherein the emphasis is on how the cap feeding device 7 moves horizontally, that is, perpendicular to the lowering direction and perpendicular to the transport direction of the container feeding device 3. Actuation is provided by a servo motor 30 mounted on the frame 2; the motor actuates a spindle drive 32 by way of a chain. The horizontally movable slide 8 is arranged underneath the spindle drive. The slide 8 is connected to the holding frame 19 (see FIG. 4) by an angle element and the plate 34. FIGS. 4 and 5 together reveal the design of the rear part of the device 1 in its preferred embodiment. The cap feeding device 7 can be actuated alternatively in some other suitable way.

The drives and connections in the embodiment described and illustrated in detail here can be replaced by elements of equivalent function. Thus the spindle drive 32 can be replaced by a drive with a linear motor, a drive with toothed belts, or by a pneumatic drive. The pneumatic drive 11 could also be replaced by an electric drive, an electromagnetic drive, or a drive using the force of springs. In the embodiment used here, special value has been placed on a mechanically reliable and sturdy solution, which has the least complexity possible and requires the least possible amount of maintenance.

In the device for sealing containers only the lightest possible weights are accelerated, which offers improved wear performance and thus lower production costs. The device comprises sturdy construction and high degree of machine availability and requires only modest maintenance costs because of its simple design.

The invention claimed is:

1. A device for sealing containers comprising:

a container feeding device for an intermittent feed of containers in a transport direction;

a cap feeding device comprising a plurality of cap gripper units forming an integral part of the cap feeding device; and a capping device movable in and opposite to a lowering direction not parallel to the transport direction, the capping device comprising a plurality of capping units corresponding to the plurality of cap gripper units in the cap feeding device, each capping unit comprising a screwing-on mechanism at one end;

wherein each screwing-on mechanism is adapted to pick up a cap and to seal the container with the cap in a lowered position of the capping device;

wherein a positive guidance is provided between the capping device and the plurality of cap gripper units, wherein the capping device comprises a driver element, which cooperates with a stop on the cap feeding device in such a way that, when the driver element comes into contact with the stop, a movement of the capping device in the lowering direction brings about the positive guidance of the plurality of cap gripper units in the lowering direction; and wherein the cap feeding device including the cap gripper units can be moved away from the capping device in a direction not parallel to the lowering direction and not parallel to the transport direction, with the stop sliding under and past the driver element, thus interrupting the positive guidance between the cap gripper units and the capping device.

2. The device of claim 1 wherein the lowering direction is substantially perpendicular to the transport direction of the container feeding device.

3. The device of claim 2 wherein the cap feeding device is movable in a direction substantially perpendicular to the lowering direction.

4. The device of claim 1 wherein the capping device comprises a driver element, which cooperates with a stop on the cap feeding device in such a way that a movement of the capping device in the lowering direction brings about the positive guidance of the plurality of cap gripper units.

5. The device of claim 4 wherein the stop of the cap feeding device is mounted on a lowering plate, wherein the lowering plate, when moving in the lowering direction, acts against an elastic force of one or more spring elements.

6. The device of claim 5 wherein the one or more spring elements are arranged between the lowering plate and a horizontally movable slide.

7. The device of claim 6 wherein the horizontally movable slide is driven by a spindle drive.

8. The device of claim 1 wherein each cap gripper unit comprises a pneumatic drive.

9. The device of claim 1 wherein each capping unit comprises a spindle drive for screwing the caps onto the containers.

10. The device of claim 1 wherein the plurality of cap gripper units move together as a unit in the lowering direction.

11. The device of claim 10 wherein the plurality of cap gripper units move together as a unit in a direction away from the capping device.

12. A device for sealing containers comprising:

a container feeding device for an intermittent feed of containers in a transport direction;

a cap feeding device comprising a plurality of cap gripper units; and a capping device movable in and opposite to a lowering direction transverse to the transport direction, the capping device comprising a plurality of capping units corresponding to the plurality of cap gripper units in the cap feeding device, each capping unit comprising a screwing-on mechanism at one end;

wherein each screwing-on mechanism is adapted to pick up a cap and to seal the container with the cap in a lowered position of the capping device; and wherein the capping device and the plurality of cap gripper units of the cap feeding device are configured and arranged such that the capping device engages the plurality of cap gripper units of the cap feeding device when the capping device is moved in the lowering direction such that the cap gripper units are positively guided in the lowering direction by the capping device, and wherein the plurality of cap gripper units are configured and arranged to disengage and move away from the capping device to interrupt a positive guidance between the cap gripper units and the capping device.

13. The device of claim 12 wherein the plurality of cap gripper units move together as a unit in a direction away from the capping device.

14. The device of claim 12 wherein the plurality of cap gripper units move together as a unit in the lowering direction.

15. The device of claim 12 wherein the entire cap feeding device is movable in a direction substantially perpendicular to the lowering direction.

16. The device of claim 12 wherein the cap feeding device is structured to move away from the capping device transverse to the lowering direction and transverse to the transport direction, thus interrupting a positive guidance between the cap gripper units and the capping device.

17. The device of claim 12 wherein the capping device comprises a driver element, which cooperates with a stop on the cap feeding device in such a way that a movement of the capping device in the lowering direction brings about the positive guidance of the plurality of cap gripper units.

18. The device of claim 17 wherein the stop of the cap feeding device is mounted on a lowering plate, wherein the lowering plate, when moving in the lowering direction, acts against an elastic force of one or more spring elements.

19. A device for sealing containers comprising:

a container feeding device for an intermittent feed of containers in a transport direction;

a cap feeding device comprising a plurality of cap gripper units; and a capping device movable in and opposite to a lowering direction, the capping device comprising a plurality of capping units corresponding to the plurality of cap gripper units in the cap feeding device, each capping unit comprising a screwing-on mechanism at one end;

wherein the plurality of cap gripper units are connected to the cap feeding device for movement therewith transverse to the transport direction and transverse to the lowering direction;

wherein each screwing-on mechanism is adapted to pick up a cap and to seal the container with the cap in a lowered position of the capping device; and wherein the capping device and the plurality of cap gripper units of the cap feeding device are configured and arranged such that the plurality of cap gripper units of the cap feeding device are positively guided in the lowering direction by the capping device engaging the plurality of cap gripper units when the capping device is moved in the lowering direction, the entire cap feeding device configured and arranged to move in the lowering direction.

20. The device of claim 19 wherein the entire cap feeding device is movable in a direction transverse to the lowering direction and transverse to the transport direction.

* * * * *